US008337338B2

(12) United States Patent
Smed

(10) Patent No.: US 8,337,338 B2
(45) Date of Patent: Dec. 25, 2012

(54) ATHLETIC SWING TRAINING DEVICE AND METHOD FOR USING SAME

(76) Inventor: Ole Falk Smed, Calgary (CA)

( * ) Notice: Subject to any disclaimer, the term of this patent is extended or adjusted under 35 U.S.C. 154(b) by 76 days.

(21) Appl. No.: 13/110,610

(22) Filed: May 18, 2011

(65) Prior Publication Data

US 2012/0295727 A1 Nov. 22, 2012

(51) Int. Cl.
*A63B 69/00* (2006.01)

(52) U.S. Cl. ..... 473/422; 473/453; 473/457

(58) Field of Classification Search ..... 473/457, 473/451, 450, 458, 464, 422, 445, 461, 453, 473/203, 229; 482/127, 94, 129, 98, 92; D21/694, 753

See application file for complete search history.

(56) References Cited

U.S. PATENT DOCUMENTS 2,134,451 A * 10/1938 Mogren ..... 482/94
2,655,378 A 10/1953 Sheffer
2,788,214 A 4/1957 Tilden
3,083,016 A * 3/1963 Sumegi ..... 473/229
3,462,156 A * 8/1969 Gentry ..... 473/229
3,529,820 A * 9/1970 Templeton ..... 482/122
3,618,942 A 11/1971 Bates
4,026,549 A * 5/1977 Gunn ..... 482/124
4,328,964 A * 5/1982 Walls ..... 482/129
4,335,875 A * 6/1982 Elkin ..... 482/74
5,007,635 A * 4/1991 Tiller ..... 482/129
5,040,788 A * 8/1991 Randall ..... 482/129
5,158,299 A 10/1992 Otter
5,269,512 A * 12/1993 Crowson et al. ..... 473/457
D362,894 S * 10/1995 Gasperoni, Sr. ..... D21/791
5,458,340 A 10/1995 Jackson
5,947,835 A * 9/1999 Fenton, Jr. ..... 473/229
6,572,497 B1 6/2003 Halsworth
6,592,474 B1 7/2003 Halsworth
6,648,780 B1 * 11/2003 Boldin ..... 473/461
6,949,035 B1 9/2005 Halsworth
7,074,131 B1 * 7/2006 Renaud ..... 473/219
7,677,992 B2 * 3/2010 Moos ..... 473/453
7,892,103 B2 2/2011 Vahary

* cited by examiner

*Primary Examiner* — Mitra Aryanpour
(74) *Attorney, Agent, or Firm* — Carl A. Hjort, III

(57) ABSTRACT

An athletic training device and a method for using same are shown, the device including an elastic cord; a grip, having a proximal end and a distal end, and having an axial bore therethrough; a connection member, disposed within the axial bore of the grip, said connection member protruding from the axial bore at the distal end of the grip and being adapted to connect the distal end of the grip to an end of the elastic cord, wherein said connection member further comprises a padded wrist strap, protruding from the axial bore at the proximate end of the grip and wherein the elastic cord is connected at its first end to the connection member of the grip, and the elastic cord is connected at its second end to an anchor, and wherein the elastic cord provides a resistance to force applied by a user in an athletic training exercise.

20 Claims, 3 Drawing Sheets

ATHLETIC SWING TRAINING DEVICE AND METHOD FOR USING SAME

DETAILED DESCRIPTION OF THE DRAWINGS

Embodiments of an athletic swing training device and a method for using same are shown and described. Generally, the athletic swing training device comprises at least one elastic cord, having a first end and a second end, both of said first and second ends having a connector attached thereto; a grip, formed in the shape of a golf club grip, having a proximal end and a distal end, and having an axial bore therethrough; a connection member, disposed within the axial bore of the grip, said connection member protruding from the axial bore at the distal end of the grip and being adapted to connect the distal end of the grip to an end of the at least one elastic cord, wherein said connection member further comprises a padded wrist strap, protruding from the axial bore at the proximate end of the grip; and wherein the at least one elastic cord is connected at its first end to the connection member at the distal end of the grip, and said at least one elastic cord is connected at its second end to an anchor, and wherein the elastic cord provides a resistance to force applied by a user in an athletic training exercise.

Figure 1:
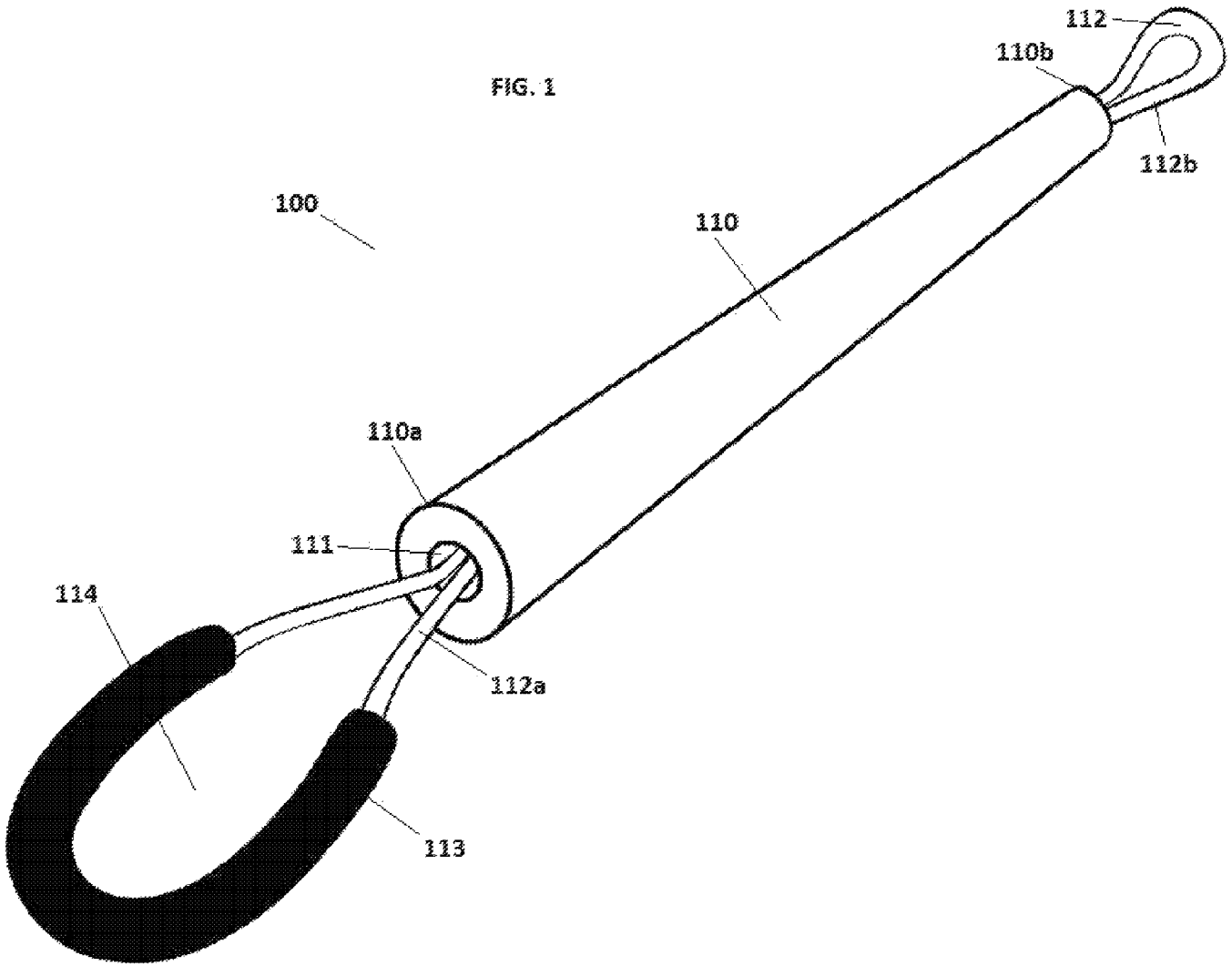
FIG. 1 is an elevational view of a grip portion of an embodiment of an athletic swing training device.

FIG. 1 shows an elevational view of a grip portion 100 of an embodiment of an athletic swing training device. As shown in FIG. 1, grip 110 is provided in the embodiment of the athletic swing training device. Grip 110 has a proximate end 110*a* and a distal end 110*b*. In an embodiment of the athletic swing training device, grip 110 may take the form of a standard golf club grip, as would be found on a typical golf club. Alternatively, grip 110 may take the form of a baseball bat grip, or the grips on any athletic device that requires the user to swing the device. Grip 110 is also provided with an axial bore 111. Axial bore 111 extends the entire length of the grip 110, from proximate end 110*a* to distal end 110*b*. In such a way, the grip member has a hollow bore all the way through it. Disposed within the axial bore 111 is connection member 112. Connection member 112 connects grip portion 110 to the elastic cord, which will be discussed in further detail infra. In an embodiment of the athletic swing training device, connection member 112 may be a flexible rope. In an alternate embodiment, connection member 112 may be formed from a steel rod. Connection member 112 extends the entire length of axial bore 111. One end of the connection member 112*b* protrudes from the axial bore at the distal end of the grip 110*b* and another end of the connection member 112*a* protrudes from the axial bore at the proximate end of the grip 110*a*. Attached to the end of connection member 112*a* protruding from the proximate end of the grip 110*a* is a padded wrist strap 113. Padded wrist strap 113 forms a loop 114, into which a user places his or her wrist when using the athletic swing training device. Padded wrist strap 113 may be made of any padding material known in the art, including by way of example and without limitation, foam, fleece or cloth.

Figure 2:
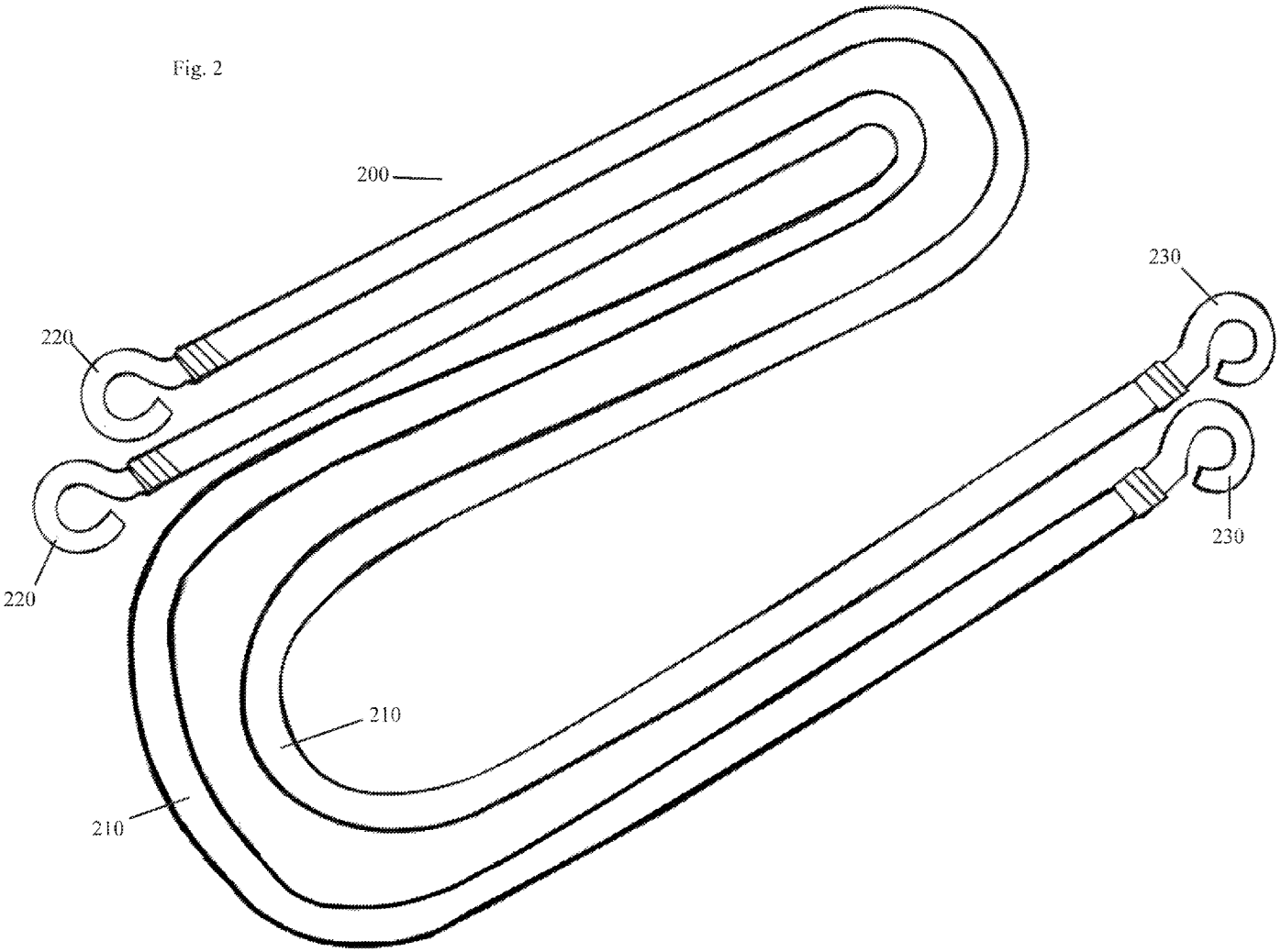
FIG. 2 is an elevational view of an elastic cord for use with an embodiment of an athletic swing training device.

FIG. 2 shows an elevational view of an elastic cord 200 for use with an embodiment of an athletic swing training device. Elastic cord 200 is formed from cord 210. By way of example, and without limitation, cord 210 may be a latex rubber cord. One of ordinary skill in the art will appreciate that cord 210 may be made of any material with sufficient elasticity as to provide an appropriate amount of resistance to the force applied by a user when an athletic swing is practiced with the device. Additionally, one of ordinary skill in the art will readily appreciate that a plurality of elastic cords 200, incorporating a plurality of cords 210 of differing elasticities may be provided to the user, so that a user may select the amount of resistance to use in an exercise. Cord 210 may be a solid or a hollow cord. In an embodiment of the athletic swing training device, cord 210, and by extension, elastic cord 200 may be approximately five feet long. One of ordinary skill in the art will readily appreciate that any length of cord 210 can be used, and that a plurality of elastic cords 200 may be provided to a user to accommodate different arrangements of exercising spaces where the user may wish to use the athletic swing trainer device. Also shown in FIG. 2 are connectors 220 and 230. Connectors 220 and 230 are attached to the ends of cord 210. Connectors 220 and 230 may be attached to cord 210 by any means known in the art. Connector 220 may be used, for example, to connect elastic cord 200 to the connection member of grip portion. Connector 230 may be used, for example, to connect elastic cord 200 to an anchor point. The ends may also be reversed such that connector 230 is attached to the grip portion and connector 220 is attached to the anchor. As shown in FIG. 2, connectors 220 and 230 may resemble hooks. Alternatively, they may take the form of rings through which clips, hooks, straps or like devices may be attached. In another embodiment, connectors 220 and 230 may be formed like a carabineer or the like, and thereby be releasably engageable with the anchor and the connection member. Connectors 220 and 230 may be of the same type or they may be of different types as described above.

Figure 3:
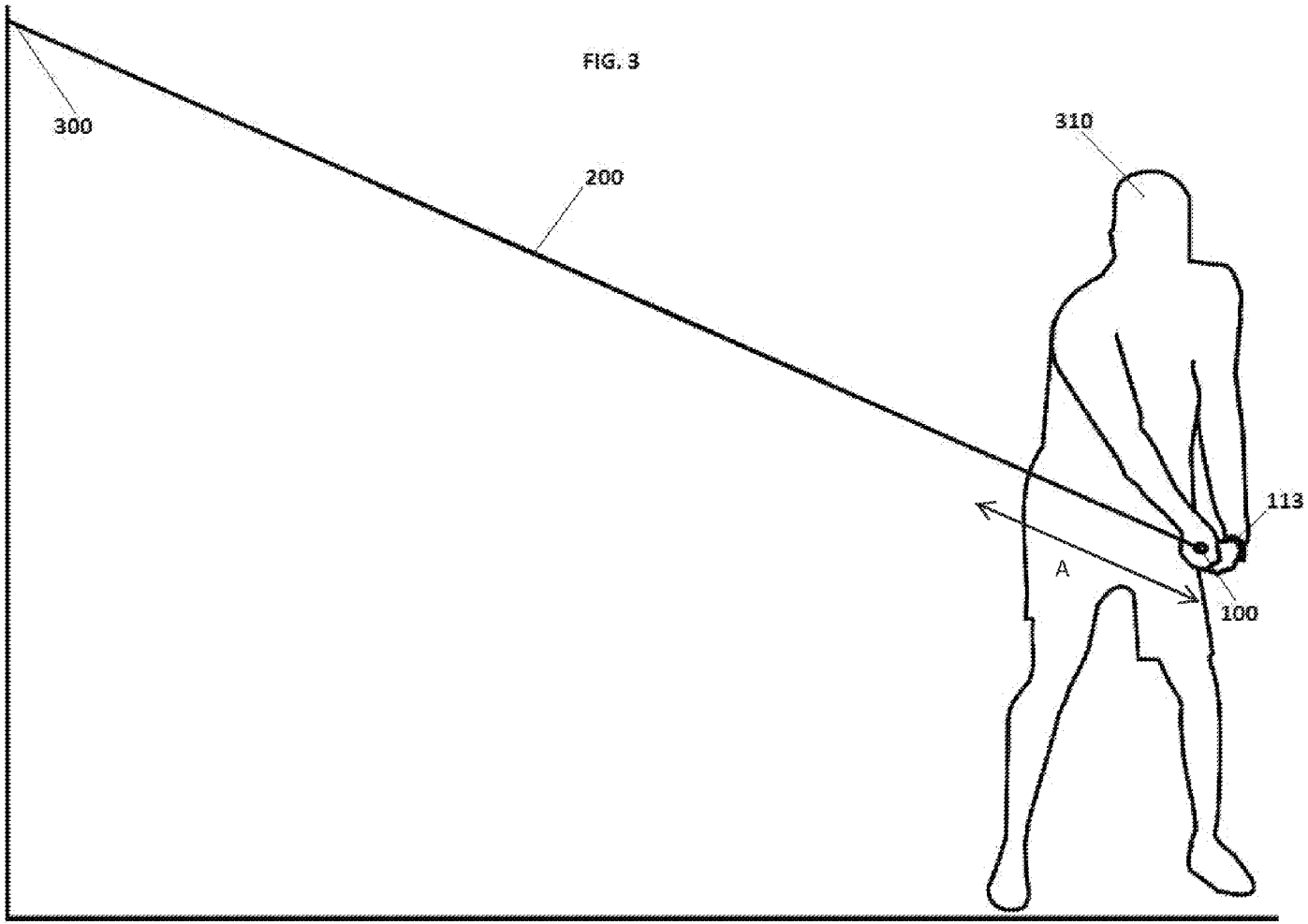
FIG. 3 is an elevational view of a user using an embodiment of the athletic swing training device.

The method of using the athletic swing training device will now be described with reference to FIG. 3. FIG. 3 shows an elevational view of a user using an embodiment of the athletic swing training device. Like numerals will be used to designate components already described in FIGS. 1 and 2. An elastic cord 200 is provided as shown in FIG. 3. A first end of the elastic cord 200 is attached via a connector (not shown) to an anchor point 300. Anchor point 300 may be on a wall as shown in FIG. 3 or any other stationary and solid surface. Anchor point 300 may be a hook or other device adapted to mate with the connector (not shown) on elastic cord 200. The second end of the elastic cord 200 is attached to the connection member (not shown) on grip portion 100. The user 310 places his or her wrist into the padded wrist strap 113, and grasps the grip of grip portion 100 with both hands. The user 310 may then swing the grip portion 100 in the direction of axis A shown in FIG. 3. When swinging the grip portion 100 along axis A, the elastic cord 200 provides resistance to the forward travel of the grip portion 100, thereby strengthening the muscles used in the swing and also training the user to keep the grip in the plane parallel to axis A, thereby improving the user's swing. In one embodiment, the swing practiced may be a golf swing. In another embodiment, the swing practiced may be a baseball swing or any other athletic swing wherein a user swings an implement during the athletic activity.

It will be appreciated by those of ordinary skill in the art that, while the forgoing disclosure has been set forth in connection with particular embodiments and examples, the disclosure is not intended to be necessarily so limited, and that numerous other embodiments, examples, uses, modifications and departures from the embodiments, examples and uses described herein are intended to be encompassed by the claims attached hereto. Various features of the disclosure are set forth in the following claims.

I claim:

1. A golf swing training device comprising:

at least one elastic cord, having a first end and a second end, both of said first and second ends having a connector attached thereto;

a grip, formed in the shape of a golf club grip, having a proximal end and a distal end, and having an axial bore therethrough;

a connection member, disposed within the axial bore of the grip, said connection member protruding from the axial bore at the distal end of the grip and being adapted to connect the distal end of the grip to either the first or second end of the at least one elastic cord, wherein said connection member further comprises a padded wrist strap, protruding from the axial bore at the proximate end of the grip; and wherein the at least one elastic cord is connected at the first end to the connection member at the distal end of the grip, and said at least one elastic cord is connected at its the second end to an anchor, and wherein the elastic cord provides a resistance to force applied by a user in a golf training exercise.

2. The golf training device of claim 1, wherein the at least one elastic cord is approximately five feet long.

3. The golf training device of claim 1, wherein a plurality of elastic cords are provided, each of said elastic cords providing a different amount of resistance, so that a user may select the amount of resistance to use in an exercise.

4. The golf training device of claim 1, wherein the connectors formed on the first and second ends of the at least one elastic cord are releasably engageable with the anchor and the connection member.

5. The golf training device of claim 1, wherein the elastic cords are formed from latex rubber cord.

6. The golf training device of claim 1, wherein the connection member comprises a flexible rope having a loop or connector at one end for connection to the at least one elastic cord and a padded wrist band on the opposite end.

7. The golf training device of claim 1, wherein the connection member comprises a loop or connector for connection to the connector on the elastic cord.

8. An athletic training device comprising:

at least one elastic cord, having a first end and a second end, both of said first and second ends having a connector attached thereto;

a grip, having a proximal end and a distal end, and having an axial bore therethrough;

a connection member, disposed within the axial bore of the grip, said connection member protruding from the axial bore at the distal end of the grip and being adapted to connect the distal end of the grip to either the first or second end of the elastic cord, wherein said connection member further comprises a padded wrist strap, protruding from the axial bore at the proximate end of the grip.

9. The athletic training device of claim 8, wherein the at least one elastic cord is approximately five feet long.

10. The athletic training device of claim 8, wherein a plurality of elastic cords are provided, each of said elastic cords providing a different amount of resistance, so that a user may select the amount of resistance to use in an exercise.

11. The athletic training device of claim 8, wherein the connectors formed on the first and second ends of the at least one elastic cord are releasably engageable with the anchor and the connection member.

12. The athletic training device of claim 8, wherein the elastic cords are formed from latex rubber cord.

13. The athletic training device of claim 8, wherein the connection member comprises a flexible rope for connection to the at least one elastic cord.

14. The athletic training device of claim 8, wherein the grip is a grip for a golf club.

15. The athletic training device of claim 8, wherein the grip is a grip for a baseball bat.

16. A method for athletic training comprising:

providing at least one elastic cord, having a first end and a second end, both of said first and second ends having a connector attached thereto;

providing a grip, having a proximal end and a distal end, and having an axial bore therethrough and a connection member, disposed within the axial bore of the grip, said connection member protruding from the axial bore at the distal end of the grip and being adapted to connect the distal end of the grip to either the first or second end of the elastic cord, wherein said connection member further comprises a padded wrist strap, protruding from the axial bore at the proximate end of the grip;

connecting the first end of the elastic cord to the connection member at the distal end of the grip and connecting the second end of the elastic cord to an anchor point;

placing a user's wrist in the padded wrist strap and having the user grasp the grip; and practicing an athletic swing against the resistance of the elastic cord.

17. The method of claim 16 wherein the athletic swing practiced is a golf swing.

18. The method of claim 16, wherein the athletic swing practiced is a baseball swing.

19. The method of claim 16, wherein a plurality of elastic cords are provided, each of said elastic cords providing a different amount of resistance, so that a user may select the amount of resistance to use in an exercise.

20. The method of claim 16, wherein the connection member comprises a flexible rope for connection to the at least one elastic cord.

* * * * *